US008113870B2

(12) United States Patent
Su et al.

(10) Patent No.: US 8,113,870 B2
(45) Date of Patent: Feb. 14, 2012

(54) CABLE CONNECTOR ASSEMBLY WITH A FRONT SHELL

(75) Inventors: Ping-Sheng Su, Tu-Cheng (TW); Jun Chen, Kunshan (CN); Qing Wang, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/968,302

(22) Filed: Dec. 15, 2010

(65) Prior Publication Data

US 2011/0143577 A1 Jun. 16, 2011

(30) Foreign Application Priority Data

Dec. 15, 2009 (CN) ..... 200920317434.9

(51) Int. Cl.
*H01R 13/58* (2006.01)

(52) U.S. Cl. ..... 439/455

(58) Field of Classification Search ..... 439/455, 439/465, 497

See application file for complete search history.

(56) References Cited

U.S. PATENT DOCUMENTS

| | | | | |
|---|---|---|---|---|
| 6,984,151 | B2 * | 1/2006 | Wu | 439/607.56 |
| 7,883,375 | B2 * | 2/2011 | Li et al. | 439/620.24 |
| 2010/0151731 | A1 * | 6/2010 | Su et al. | 439/607.35 |

FOREIGN PATENT DOCUMENTS

CN 2390286 Y 8/2000

* cited by examiner

*Primary Examiner* — Renee Luebke
*Assistant Examiner* — Larisa Tsukerman
(74) *Attorney, Agent, or Firm* — Wei Te Chung; Andrew C. Cheng; Ming Chieh Chang

(57) ABSTRACT

A cable connector assembly (100) in accordance with the present invention comprises an insulative housing (1) and a plurality of contacts (2) received therein, a cable (5) connected with the contacts (2), a strain relief portion molded on the cable (5), the strain relief portion having a extruding portion (52) on a front end thereof and a retaining portion (51) behind the extruding portion (52), the retaining portion (51) also having a pair of locking blocks (53) at opposite sides thereof, and a cover (8) enclosing the aforementioned components, a back surface of the cover (8) defining a pair of gaps (826) at opposite sides thereof and connected with the correspondence locking block (53) in order to make the strain relief portion and the cover (8) assemble together.

9 Claims, 5 Drawing Sheets

CABLE CONNECTOR ASSEMBLY WITH A FRONT SHELL

BACKGROUND OF THE INVENTION

1. Field of the Invention

The present invention generally relates to a cable connector assembly, and more particularly to a cable connector assembly used for locking the strain relief thereof.

2. Description of Related Art

Nowadays, cable connector assemblies contain a strain relief molding outside the cable, and then put the cable molding with the strain relief in the shell of the cable assembly, CN patent No. 2390286Y issued on Aug. 2, 2000 to Lai discloses a cable connector assembly, the cable connector assembly comprises a method of installing the strain relief in the space of the shell, because of the joint force between the strain relief and the shell is small may occur the strain relief remove in the shell and then effect the electrical transmission.

Correspondingly, it is desired to have a cable connector assembly with improved jointing force between the strain relief and the shell.

BRIEF SUMMARY OF THE INVENTION

Accordingly, an object of the present invention is to provide a cable connector assembly may enforce the joint force between the strain relief and the shell.

In order to achieve the above-mentioned object, a cable connector assembly in accordance with the present invention comprises an insulative housing and a plurality of contacts received therein, a cable connected with the contacts, a strain relief portion molded on the cable, the strain relief portion having a extruding portion on a front end thereof and a retaining portion behind the extruding portion, the retaining portion also having a pair of locking blocks at opposite sides thereof, and a cover enclosing the aforementioned components, a back surface of the cover defining a pair of gaps at opposite sides thereof and connected with the correspondence locking block in order to make the strain relief portion and the cover assemble together.

Other objects, advantages and novel features of the invention will become more apparent from the following detailed description of the present embodiment when taken in conjunction with the accompanying drawings.

DETAILED DESCRIPTION OF THE INVENTION

Figure 1:
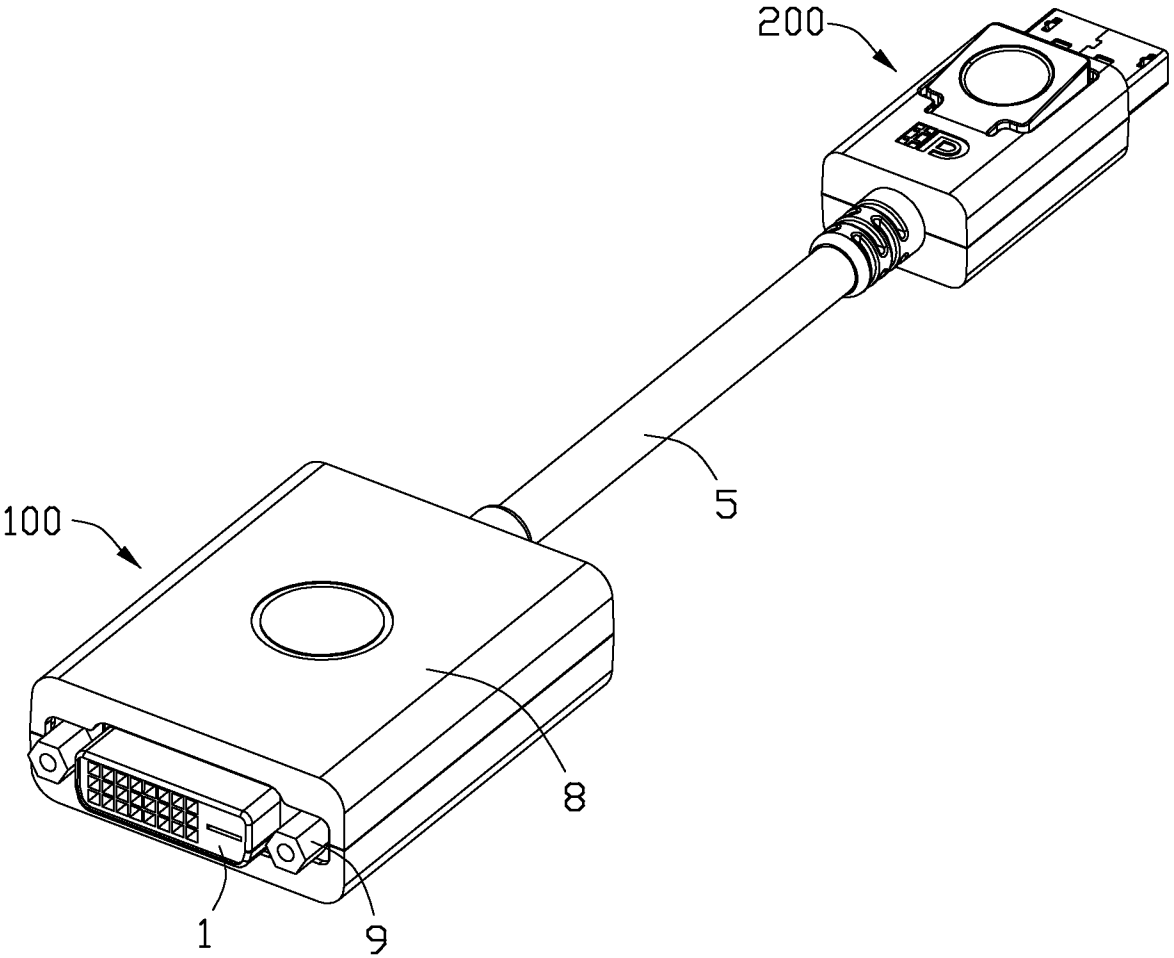
FIG. 1 is an assembled, perspective view of a cable connector assembly of the present invention connected with a Display port connector.

Reference will now be made to the drawing figures to describe the present invention in detail.

Figure 2:
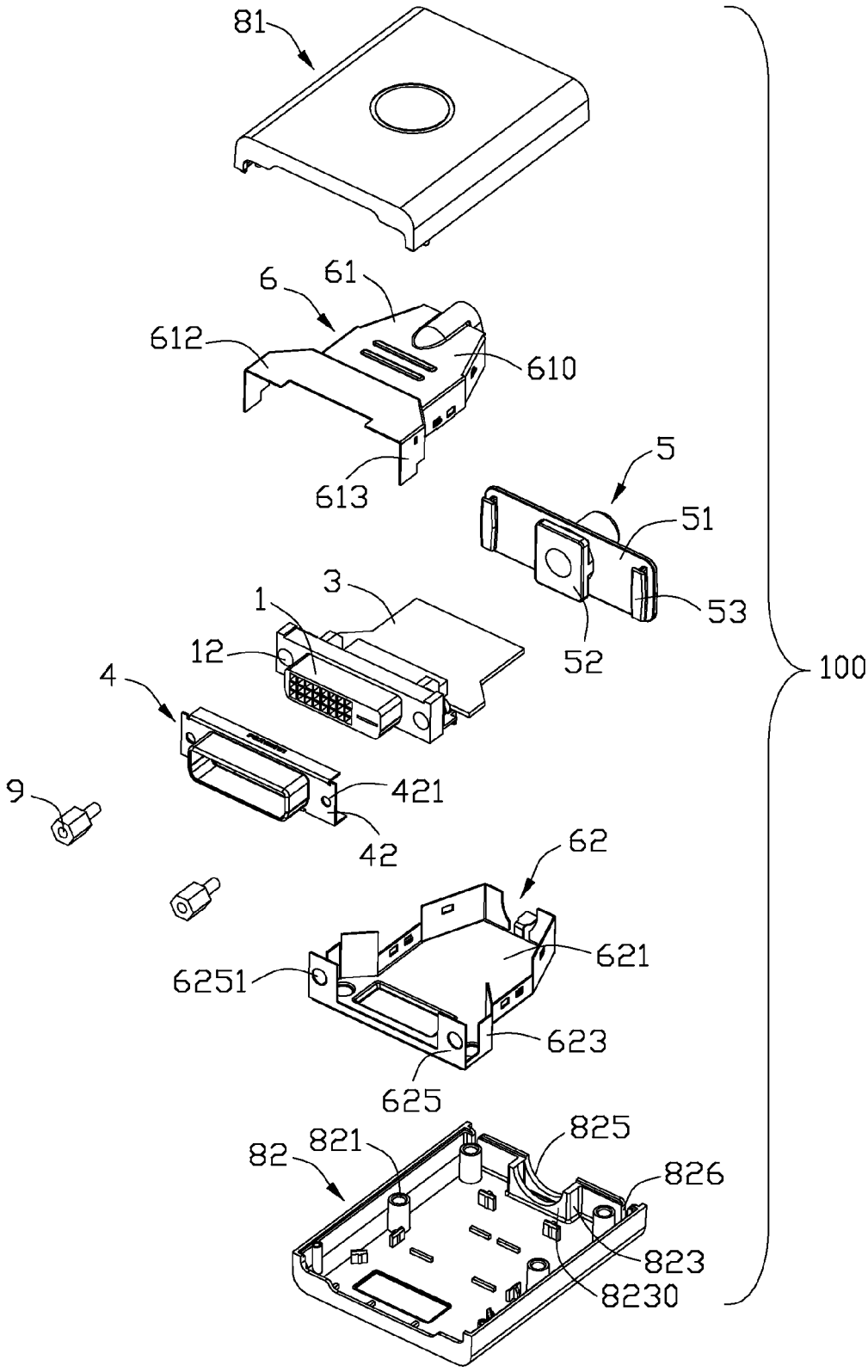
FIG. 2 is an exploded, perspective view of the cable connector assembly.
Figure 3:
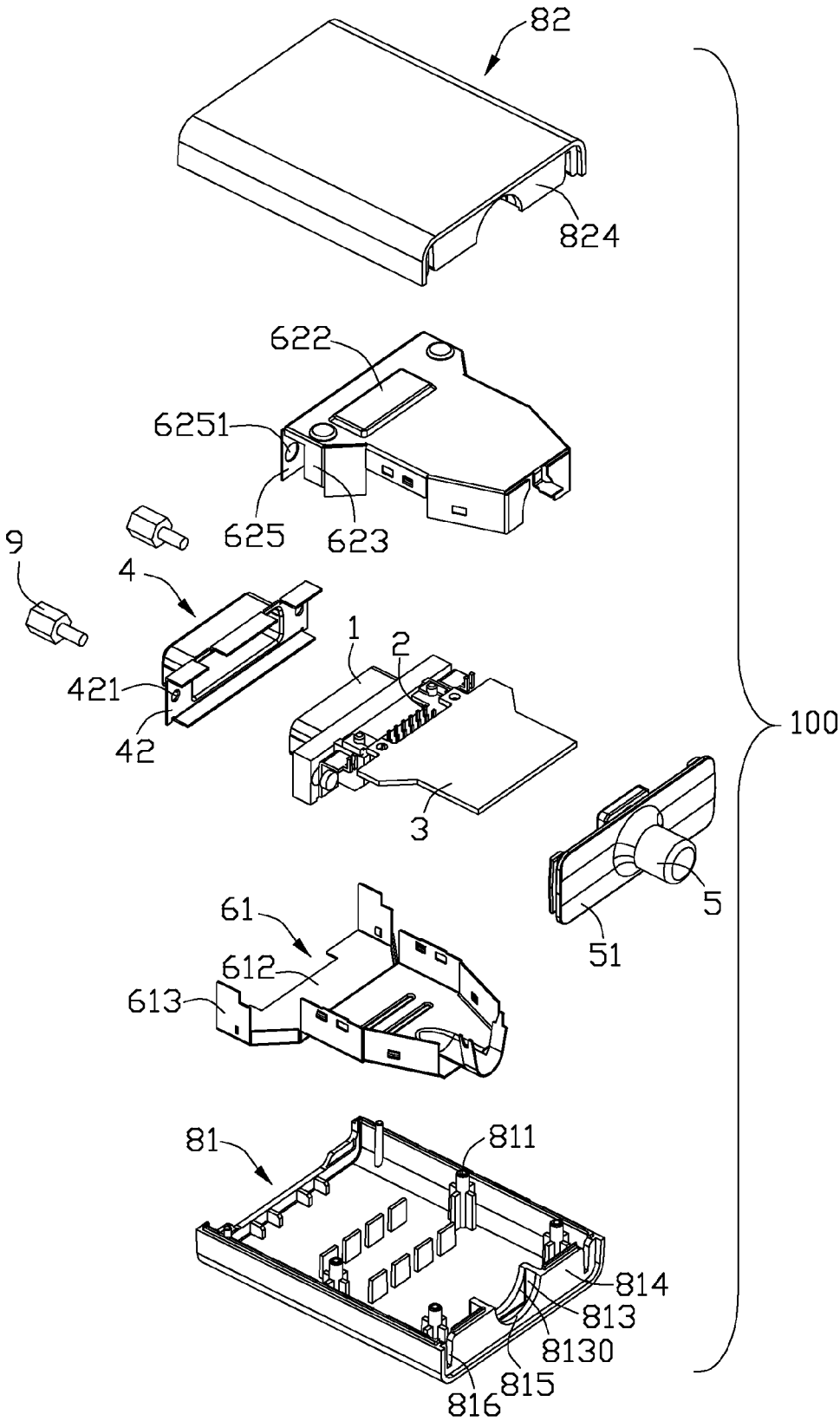
FIG. 3 is similar to FIG. 2, but viewed from another aspect.
Figure 4:
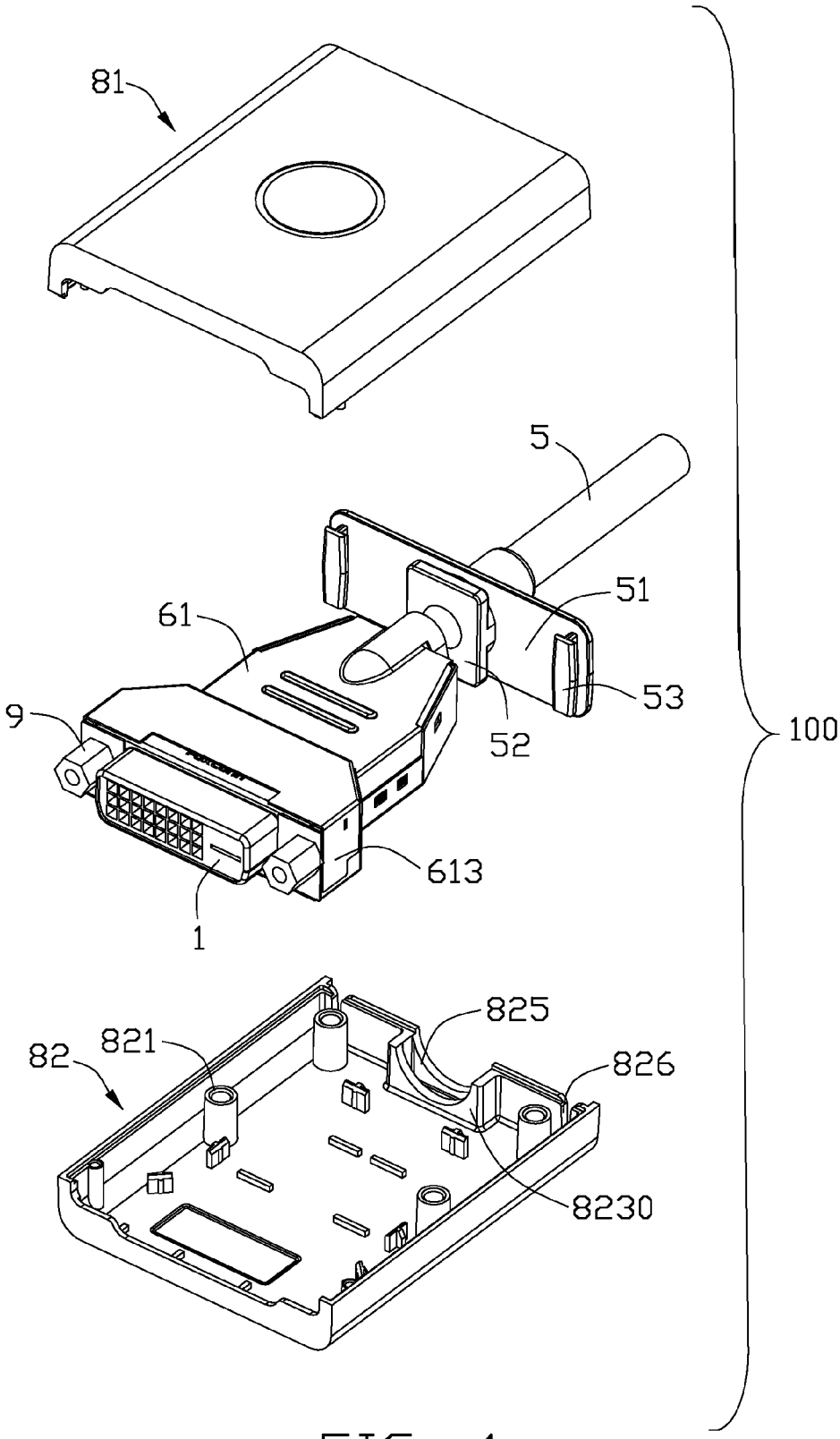
FIG. 4 is a partially assembled, perspective view of the cable connector assembly shown in FIG. 2.
Figure 5:
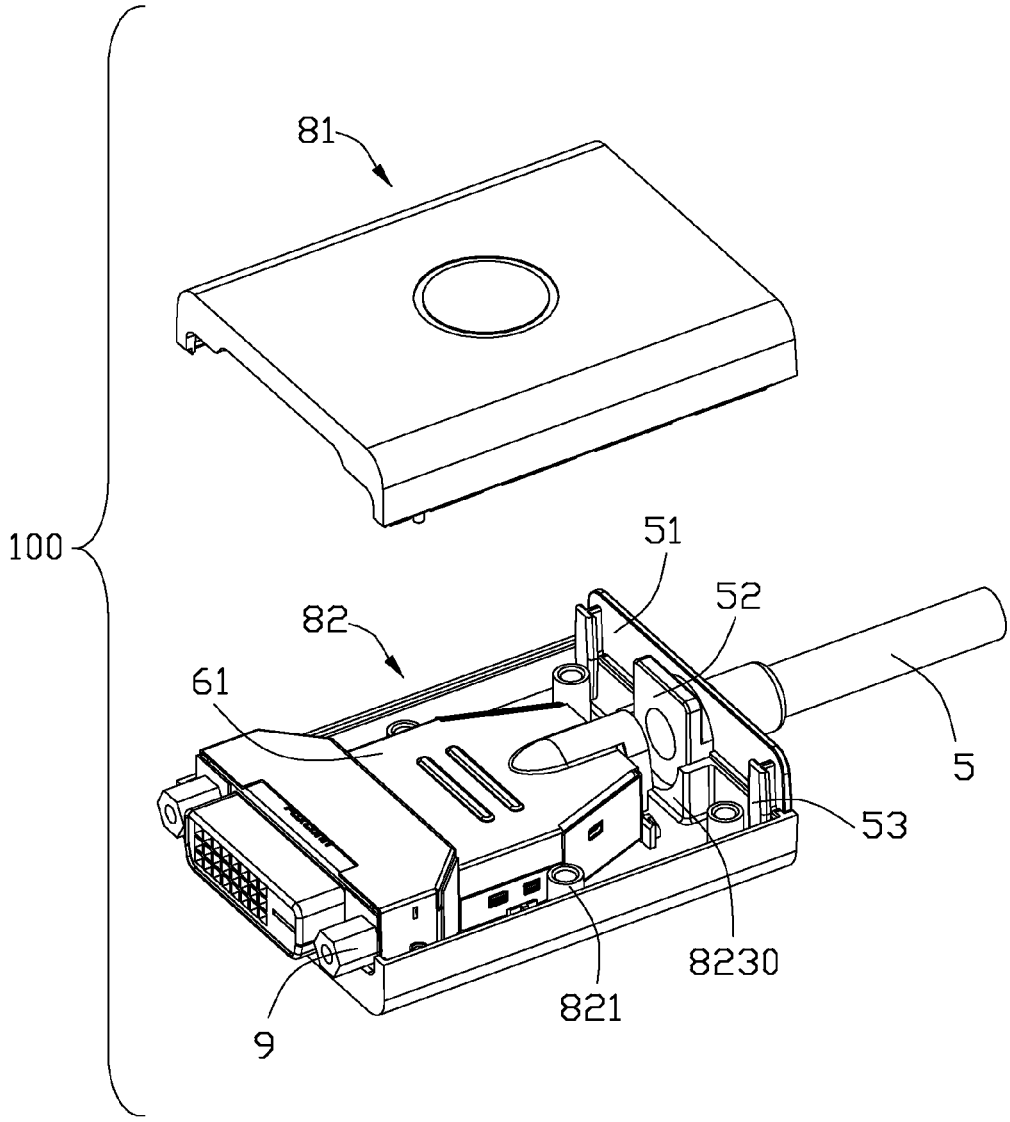
FIG. 5 is another partially assembled, perspective view of the cable connector assembly shown in FIG. 2.

Referring to FIGS. 1-3, a cable connector assembly 100 in accordance with the present invention can be connected with another cable connector assembly 200 compatible with Display Port transmitting protocol to form an adapter. And the cable connector assembly 100 comprises an insulative housing 1, a plurality of contacts 2 received in the insulative housing 1, a print circuit board 3, a metallic shielding 4 enclosing a mating port of the insulative housing 1, a cable 5, a metallic shell 6 enclosing the printed circuit board 3 and partial of the housing 1 and the cable 5, and a cover 8 enclosing the aforementioned components. The cover 8 is made of insulative material, and comprises an upper cover 81 and an lower cover 82 assembled to each other along a direction perpendicular to a mating direction.

Referring to FIGS. 2-5, the cable connector assembly 100 is compatible with Digital Visual Interface (DVI) transmitting protocol. The contacts 2 are assembled in the insulative housing 1, and tail portions of the contacts 2 are bent downwards beyond the lower surface of the housing 1 and soldered to the printed circuit board 3.

Referring to FIGS. 1-3, the insulative housing 1 defines a pair of fastening holes 12 at opposite sides thereof, a pair of nuts 9 are mounted in the corresponding fastening holes 12 and coupled to a complementary connector (not shown). The metallic shielding member 4 is enclosing the insulative housing 1 and the mating port of the cable connector assembly 100 to reduce Electro Magnetic Interference (EMI). The sheiding member 4 defines a vertical wall 42 with a pair of through holes 421 respectively aligned with corresponding fastening holes 12 along the mating direction.

The cable 5 defines a strain relief portion (not labeled) on the front segment thereof, the strain relief portion has a extruding portion 52 on a front end thereof and a rectangular retaining portion 51 behind the extruding portion 52. The retaining portion 51 is spaced apart from the protruding portion 52, and the retaining portion 51 has a larger width than the protruding portion 52 along a transverse direction. The retaining portion 51 also has a pair of locking blocks 53 at opposite sides thereof along a transverse direction. The locking blocks 53 are T-Shaped, the cable 5 also comprises a plurality of wires (not shown).

The shell 6 is made of metallic material and comprises a top shell 61 and a bottom shell 62 assembled to each other. The top shell 61 comprises a base portion 610 and an extension portion 612 bending upwards firstly and then extending forwardly from the base portion 610, the extension portion 612 is wider than the base portion 610 along the transverse direction. The top shell 61 defines a pair of side walls 613 bent downwardly.

The bottom shell 62 comprises a lower wall 621 and a pair of lateral walls 623 bent upwards from both sides of the lower wall 621. The lateral walls 623 are engaging with the corresponding side walls 613 of the top shell 61. The lower wall 621 is recessed downwards to form a depression 622, a pair of blocking portion 625 are located on the front end of the lower wall 621 and bent upwards to be perpendicular to the mating direction, and each blocking portion 625 defines a circular matching hole 6251.

The cover 8 is made of insulative material and comprises a upper cover 81 and a lower cover 82 assembled to each other, The upper cover 81 defines a plurality of posts 811 around an inner wall thereof equably, The lower cover 82 defines a plurality of engaging holes 821 cooperating with corresponding posts 811. The upper cover 81 and the lower cover 82 have the same configuration with each other, both of the upper cover 81 and the lower cover 82 define a clipping portion 813,823 and a groove 814,824 extending forward from the back surface of the cover 8. The clipping portion has clipping surface 8130,8230. two arc-shaped cutout 815 recessed upwards from the lower surface of the clipping portion 813 and spart from each other along the mating direction, two arc-shaped cutouts 825 recessed downwards from the upper surface of the clipping portion 823 and spart from each other along the mating direction. The back surface of the upper cover 81 defines a pair of gaps 816 at opposite sides thereof, The back surface of the lower cover 82 defines a pair of gaps 826 at opposite sides thereof.

In assemble, the contacts 2 are received in the insulative housing 1, tail portion of the contacts 2 are soldered to a front of the printed circuit board 3. The shielding member 4 is enclosing the insulative housing 1. The wires of the cable 5 are soldered to a back area of the print circular board 3. The aforementioned elements are assembled into the bottom shell 62. the blocking portions 625 are adjacent to a front surface of the shielding member 4, segments of the contacts 2 inserted through the printed circular board 3 are located in the depression 622 of the bottom shell 62. The mating holes 6251 of the bottom shell 62, the through holes 421 of the shielding member 4 and the fastening holes 12 of the insulative housing 1 are aligning with each other along the mating direction, and the nuts are inserted into the corresponding mating holes 6251, the through holes 421 and the fastening holes 12 successfully, and to realize the mechanical connection between the bottom shell 62, the shielding member 4 and the housing 1.

Then the top shell 61 is assembled to the bottom shell 62 along an up-to-down direction, the side walls 613 of the top shell 61 are engaging with the lateral walls 623 of the bottom shell 62 to combine the top shell 61 and the bottom shell 62. The extension portion 612 of the top shell 61 is shielding a rear section of the insulative housing 1, and the base portion 610 is located above the printed circuit board 4. Therefore, the shell 6 is enclosing the shielding member 4, the housing 1 and the electrical connection area to reduce EMI.

Then the cover 8 is assembled to the aforementioned elements, the retaining portion 51 of the cable 5 is disposed in the receiving groove 824 of the lower cover 82 to prevent the cable 5 moving forth, the protruding portion 52 of the cable 5 is located in the arc-shaped cutouts 815 825, the locking blocks 53 of the cable is located in the gaps 526, then the upper cover 81 is assembled to the lower cover 82 along the up-to-down direction, the posts 811 of the upper cover 81 are inserted into the corresponding engaging holes 821 of the lower cover 82, and the clipping portions 813 of the upper cover and the lower cover 82 are cooperated with each other to retain the cable 5. The retaining portion 51 is located in the arc-shaped cutouts 815, the locking blocks 53 is located in the gaps 816. Thus, the cable connector assembly 100 is assembled.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly, comprising:

an insulative housing and a plurality of contacts received therein;

a cable connected with the contacts;

a strain relief portion molded on the cable, the strain relief portion having a extruding portion on a front end thereof and a retaining portion behind the extruding portion, the retaining portion also having a pair of locking blocks at opposite sides thereof; and a cover enclosing the insulative housing, the cable and the strain relief, a back surface of the cover defining a pair of gaps at opposite sides thereof and connected with the locking blocks, wherein the retaining portion is rectangular shaped, and the retaining portion has a larger width than the protruding portion along a transverse direction;

the cover comprises an upper cover and a lower cover, both of the upper cover and the lower cover define a clipping portion, two arc-shaped cutouts recessed downwardly from the upper surface of the clipping portion;

the two arc-shaped cutouts apart from each other along the mating portion;

the extruding portion is arranged in the middle of the two arc-shaped cutouts, and a groove extends forwardly from a back surface of the cover in order to prevent the cable moving forwardly.

2. The cable connector assembly as claimed in claim 1, wherein the cable connector assembly further includes a metallic shell enclosing a back end of the insulative housing, and the metallic shell is located on the front of the arc-shaped cutouts.

3. The cable connector assembly as claimed in claim 2, wherein the pair of blocking portions are located in the front end of the metallic shell and each of the blocking portion defines a matching hole.

4. The cable connector assembly as claimed in claim 3, wherein the housing defines a pair of fastening holes at opposite sides thereof, and the fastening hole aligns with the matching hole.

5. The cable connector assembly as claimed in claim 4, wherein the metallic shell comprises a top shell and a bottom shell, and the blocking portions formed at least in one of the top cover and the bottom shell.

6. The cable connector assembly as claimed in claim 4, wherein a pair of nuts are mounted in the fastening hole and the matching hole in order to fasten the housing and the metallic shell together.

7. An electrical cable connector assembly comprising:

a cover including a receiving space defined transversely between a pair of side walls, and a rear wall transversely extending between said pair of side walls and located behind the receiving space;

an opening defined in the rear wall around a center line thereof;

an insulative housing disposed in a front portion of the receiving space with a mating port extending forwardly beyond the receiving space;

a plurality of contacts disposed in the housing;

a cable extending in a rear portion of the receiving space and rearwardly out of the receiving space; and a strain relief surrounding said cable around the rear wall; wherein said strain relief extends transversely with a distance similar to the transverse dimension of the rear wall, and said strain relief retains to the rear wall not only around the opening but also around other two opposite positions by two sides of the opening of the rear wall in a transverse direction, wherein retention between the strain relief and the rear wall is performed by the rear wall being sandwiched between the extruding and retaining portions of strain relief in an axial direction of the cable.

8. The electrical cable connector assembly as claimed in claim 7, wherein said two opposite positions are essentially adjacent to said pair of side walls, respectively.

9. The electrical cable connector assembly as claimed in claim 8, wherein said strain relief defines a transverse dimension similar to that of the rear wall and applied upon an exterior surface of the rear wall.

* * * * *